US010858217B2

(12) United States Patent
Poutiainen

(10) Patent No.: US 10,858,217 B2
(45) Date of Patent: Dec. 8, 2020

(54) HOSE REEL

(71) Applicant: Fiskars Finland Oy Ab, Helsinki (FI)

(72) Inventor: Vesa Poutiainen, Espoo (FI)

(73) Assignee: Fiskars Finland Oy Ab, Helsinki (FI)

( * ) Notice: Subject to any disclaimer, the term of this patent is extended or adjusted under 35 U.S.C. 154(b) by 185 days.

(21) Appl. No.: 15/974,380

(22) Filed: May 8, 2018

(65) Prior Publication Data

US 2018/0334355 A1 Nov. 22, 2018

(30) Foreign Application Priority Data

May 17, 2017 (FI) ..... 20175447

(51) Int. Cl.

| | |
|---|---|
| ***B65H 75/48*** | (2006.01) |
| ***B65H 75/40*** | (2006.01) |
| ***B65H 75/44*** | (2006.01) |
| ***B65H 75/36*** | (2006.01) |

(52) U.S. Cl.

CPC ..... *B65H 75/486* (2013.01); *B65H 75/364* (2013.01); *B65H 75/40* (2013.01); *B65H 75/4426* (2013.01); *B65H 75/4471* (2013.01); *B65H 2701/33* (2013.01)

(58) Field of Classification Search

CPC .. B65H 75/486; B65H 75/4426; B65H 75/40; B65H 75/4471; B65H 75/364; B65H 2701/33; B65H 75/48

See application file for complete search history.

(56) References Cited

U.S. PATENT DOCUMENTS

| | | | | |
|---|---|---|---|---|
| 1,746,995 A * | 2/1930 | Edwards | B65H 75/38 | 137/355.17 |
| 1,982,610 A * | 11/1934 | Cleo | B65H 75/38 | 137/355.22 |
| 2,496,489 A * | 2/1950 | Palm | F16N 5/00 | 137/355.2 |
| 2,519,064 A * | 8/1950 | Palm | B65H 75/38 | 137/355.19 |

(Continued)

FOREIGN PATENT DOCUMENTS

| | | |
|---|---|---|
| CN | 1211225 A | 3/1999 |
| CN | 1359351 A | 7/2002 |

(Continued)

OTHER PUBLICATIONS

Extended European Search Received for EP Application No. 18170970.0, dated Oct. 15, 2018, 8 pages.

(Continued)

*Primary Examiner* — William A. Rivera

(74) *Attorney, Agent, or Firm* — Foley & Lardner LLP

(57) ABSTRACT

A hose reel includes a frame, a reel rotatably arranged within the frame and a rewind mechanism with a spring. A removable lid is attached to the frame and encloses an inside of the hose reel from all directions to prevent a user of the hose reel from accessing the inside of the hose reel. An axle is rotatable in relation to the reel. A first end of the spring is attached to the reel and a second end of the spring is attached to the axle. The axle has an outer end connected to the lid to prevent mutual rotation between the lid and the outer end in a direction which decreases the spring force of the spring.

10 Claims, 4 Drawing Sheets

(56) References Cited

U.S. PATENT DOCUMENTS

| | | | | |
|---|---|---|---|---|
| 2,595,655 | A | 5/1952 | Hannay | |
| 2,742,242 | A * | 4/1956 | Godwin | B65H 75/4471 242/378.2 |
| 3,612,094 | A * | 10/1971 | Hare | B65H 75/38 137/355.2 |
| 4,757,838 | A | 7/1988 | McGullion | |
| 5,335,687 | A * | 8/1994 | Odom | B65H 75/364 137/15.01 |
| 6,050,290 | A | 4/2000 | Yacobi et al. | |
| 6,273,354 | B1 * | 8/2001 | Kovacik | B65H 75/40 191/12.2 R |
| 6,807,982 | B1 | 10/2004 | Ames | |
| 7,344,103 | B1 | 3/2008 | Eley | |
| 7,559,501 | B2 * | 7/2009 | Jian | B65H 75/4407 137/355.23 |
| 7,857,000 | B1 | 12/2010 | Langdon | |
| D767,374 | S | 9/2016 | Vanttila et al. | |
| D787,921 | S | 5/2017 | Vanttila et al. | |
| D792,756 | S | 7/2017 | Vanttila et al. | |
| 2004/0163710 | A1 * | 8/2004 | Kovacik | B65H 75/38 137/355.23 |
| 2009/0189005 | A1 * | 7/2009 | Roman | B65H 75/4447 242/381 |
| 2010/0294897 | A1 * | 11/2010 | Georgey | B65H 75/446 248/75 |
| 2013/0168482 | A1 | 7/2013 | Moore | |
| 2014/0151527 | A1 | 6/2014 | Sawhney et al. | |
| 2017/0107076 | A1 | 4/2017 | Barnes | |

FOREIGN PATENT DOCUMENTS

| | | | |
|---|---|---|---|
| CN | 2685299 | Y | 3/2005 |
| CN | 201626742 | U | 11/2010 |
| CN | 102612479 | A | 7/2012 |
| CN | 202744115 | U | 2/2013 |
| CN | 203187238 | U | 9/2013 |
| CN | 203246975 | U | 10/2013 |
| CN | 103456285 | A | 12/2013 |
| CN | 203333088 | U | 12/2013 |
| CN | 203450969 | U | 2/2014 |
| CN | 105731194 | A | 7/2016 |
| CN | 205590095 | U | 9/2016 |
| CN | 205675917 | U | 11/2016 |
| CN | 205953226 | U | 2/2017 |
| DE | 20 2013 100 598 | U1 | 4/2013 |
| EP | 0 493 736 | A2 | 7/1992 |
| FI | 10179 | U1 | 8/2013 |
| FI | 10903 | U1 | 6/2015 |
| GB | 1 299 162 | A | 12/1972 |
| WO | WO-99/06316 | A1 | 2/1999 |
| WO | WO-99/41183 | | 8/1999 |
| WO | WO-2011/059710 | A1 | 5/2011 |

OTHER PUBLICATIONS

U.S. Appl. No. 29/576789, filed Sep. 7, 2016, Lyytikainen et al.
U.S. Appl. No. 29/626067, filed Nov. 14, 2017, Lyytikainen et al.
Search Report for Finnish Application No. 20175446, dated Dec. 8, 2017, 2 pages.
Search Report for Finnish Application No. 20175447, dated Dec. 8, 2017, 2 pages.
English Translation of Search Report for Chinese Application No. 201810471042.1, dated Aug. 2, 2019, 7 pages.
English Translation of Search Report for Chinese Application No. 201810471093.4, dated Aug. 6, 2019, 9 pages.
Office Action Received for Canadian Application No. 3,004,103, dated Mar. 8, 2019, 4 pages.
Office Action Received for Canadian Application No. 3,004,108, dated Mar. 19, 2019, 3 pages.

* cited by examiner

HOSE REEL

CROSS-REFERENCE TO RELATED APPLICATION

This application claims the benefit of and priority to Finland Application No. 20175447, filed May 17, 2017, the content of which is hereby incorporated by reference in its entirety.

FIELD OF THE INVENTION

This invention relates to hose reel for a garden hose, for instance. In particular the invention relates to a hose reel with an automatic rewind mechanism.

DESCRIPTION OF PRIOR ART

Previously there is known a hose reel with a frame having a reel rotatably arranged within the frame. In this hose reel a rewind mechanism with a spring is utilized for rewinding a hose to the reel once a user has stopped using the hose.

A drawback with with an automatic hose reel of this type is that a user needs to be very careful while carrying out maintenance work to the hose reel. The reason is that the spring is continuously under tension. While the hose is entirely pulled out from the reel, the spring force is at its maximum. However, in order to ensure that the entire hose is re-winded onto the reel, a certain amount of pre-tension is also needed in the spring while the hose is fully re-winded on the reel.

If a user, by accident, comes into contact with the moving parts of the reel or with the spring while the spring force is suddenly released, possibly by rotating the reel, there is a risk of injury.

SUMMARY OF THE INVENTION

An object of the present invention is to solve the above mentioned problem and to provide a hose reel with a design efficiently preventing the risk of injury. This object is achieved with a hose reel according to independent claim 1.

The spring force of the spring can be efficiently and securely handled when the hose reel is provided with a removable lid which together with the frame prevents a user from accessing an inside of the hose reel. When in such a hose reel one end of the spring is attached to a rotatable axle which via engagement means is connected to the lid to prevent mutual rotation between the lid and an outer end of the axle in a direction which decreases the spring force of the spring, it is not possible to remove the lid without releasing the spring tension.

In this way, as soon as the lid is removed, there is no longer any risk of injury for the user.

Preferred embodiments of the hose reel are disclosed in the dependent claims.

BRIEF DESCRIPTION OF DRAWINGS

In the following the hose reel will be described in closer detail by way of example and with reference to the attached drawings, in which.

DESCRIPTION OF AT LEAST ONE EMBODIMENT

Figure 1:
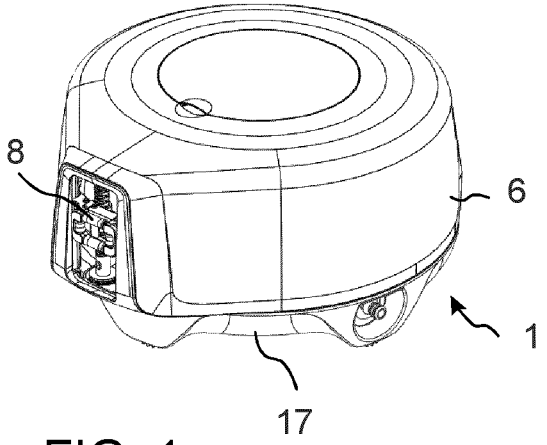
FIGS. 1 to 6 illustrate a first embodiment of a hose reel.
Figure 2:
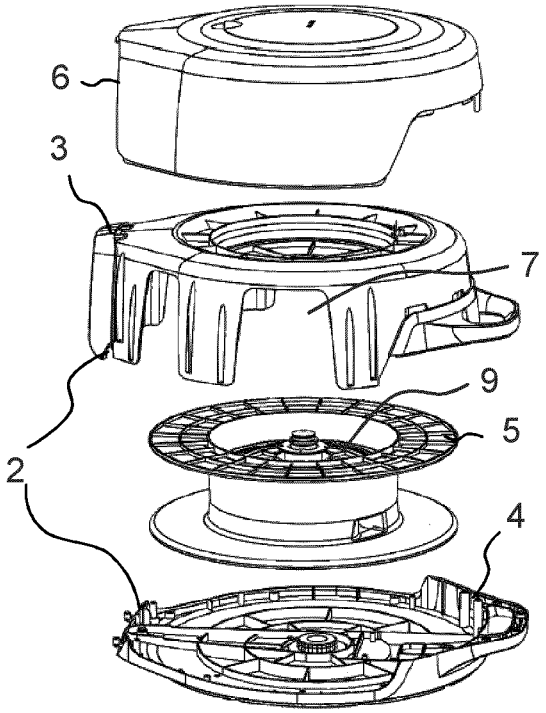
Figure 3:
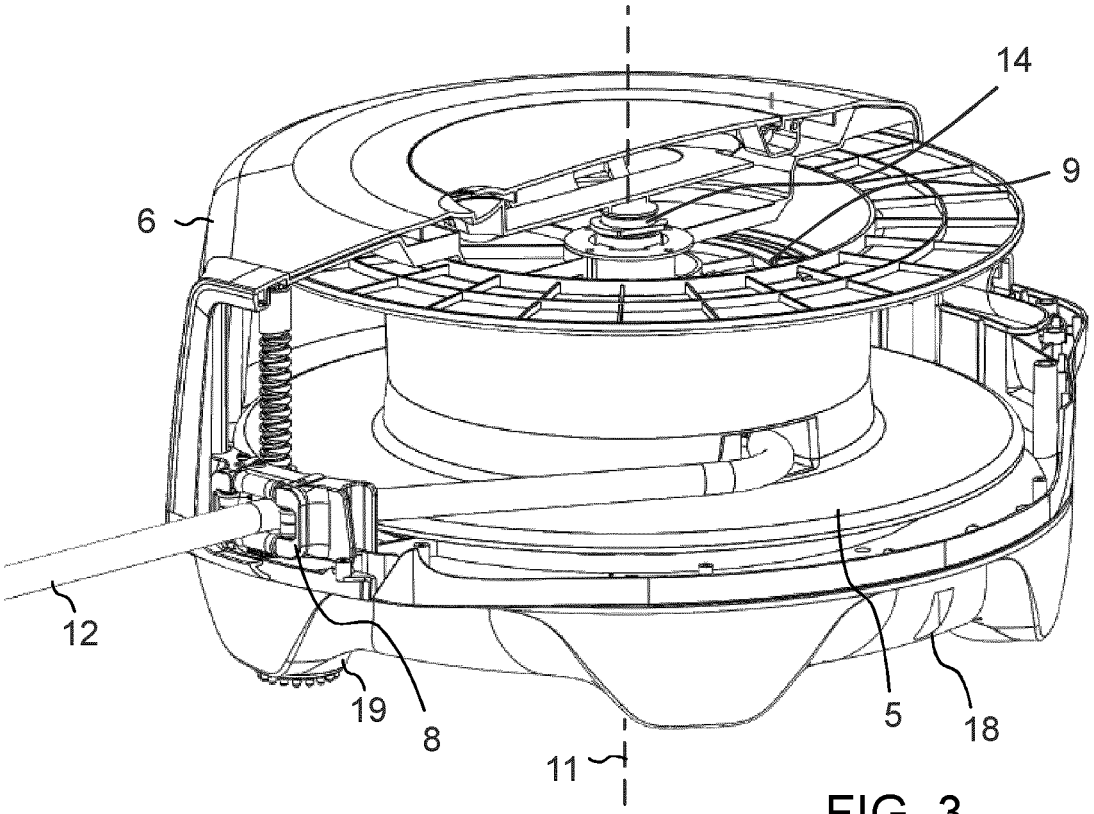

FIG. 1 illustrates a hose reel 1 from above, FIG. 2 illustrates an exploded view of a part of the hose reel 1 before assembly and FIG. 3 illustrates a partial cross section of the hose reel 1. The hose reel comprises a frame 2 which in this example comprises an upper frame part 3 and a lower frame part 4 attached to each other. A reel 5 is rotatably arranged within the frame 2 such that the reel can be accessed via side openings 7 in the frame.

In the illustrated examples it is by way of example assumed that the hose reel is a free standing hose reel provided with a reel 5 rotating around a vertical rotation axis 11, in other words an axis which is perpendicular to the base (in praxis usually the ground). However, alternatively the invention can be utilized also in a hose reel which via an attachment bracket is mounted to a wall such that the reel rotates around a horizontal rotation axis, for instance.

In the illustrated embodiment, the hose reel 1 is additionally provided with a removable lid 6, which is attached to the frame 2. This lid 6 has solid, non-perforated outer surfaces which while the lid is attached to the frame, cover the side openings 7 of the frame 2. Thereby the lid 6 together with the frame 2 encloses an inside of the hose reel 1 substantially from all directions to prevent a user of the hose reel 1 from accessing the inside of the hose reel. In this way, the lid and frame prevent the fingers of a user from coming into contact with the rotating reel 5, the spring 9 and other components which which may be dangerous and seriously injure the user. Only on the front side of the hose reel 1 an opening is provided by a guide 8 via which the hose 12 can be pulled out from the hose reel 1. Additionally, as the reel is provided within the frame, removal of the lid 6 can be carried out without a risk that the reel itself, or other parts of the hose reel that also are located within the frame (such as the guide or spirng), falls off the hose reel at that stage. In this way it can be ensured that change of hose, for instance, remains simple as the risk that other parts may accidentally fall of the hose reel during hose change is prevented by means of the frame that remains in place even though the lid is removed.

In order to make the hose reel 1 as easy to use as possible, the hose reel 1 is provided with a ground support 17 with a bottom surface 18 that is provided with contact areas 19 for supporting the hose reel from the base. In the illustrated example, the ground support 17 is rotatably attached to the frame. This allows the frame 4 of the hose reel 1 to rotate in relation to the ground support 17. Such an attachment between the frame 2 and the ground support 17 facilitates that the frame 2 can rotate more than 360° (limitless) in relation to the ground support 17. This is an advantage in a free standing hose reel located on the ground, for instance, as the frame 2 in that case always automatically rotates into a position where the guide 8 is directed towards the user when the user pulls out the hose from the hose reel. In this position, once the user stops using the hose, the guide of the hose reel is directly in an optimal position for rewinding the hose to the reel.

Figure 4:
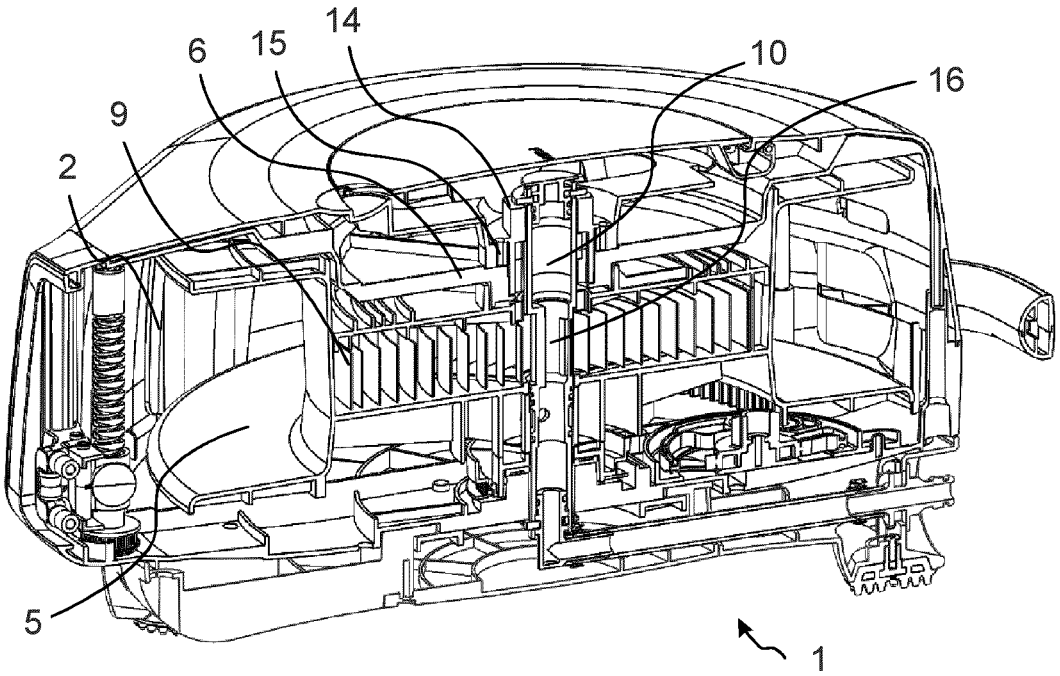
Figure 5:
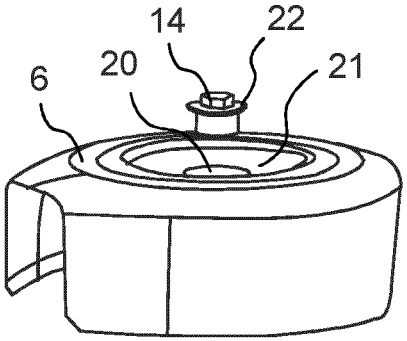
Figure 6:
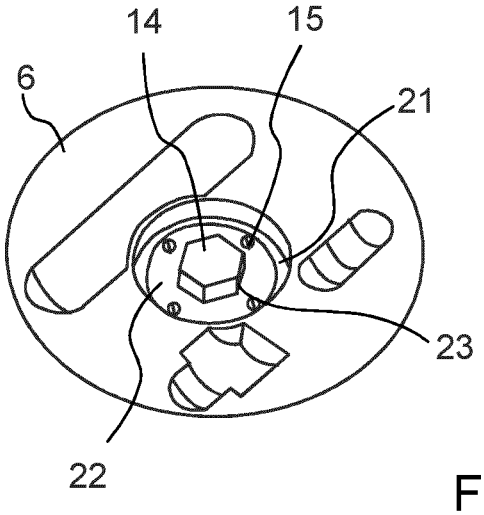

In the following the attachment on the removable lid 6 will be explained with reference to FIGS. 4 to 6. The spring 9, which in the illustrated example is a torsion spring, can be seen in the partial cross-section of FIG. 4. A first (outer) end of the spring 9 is attached to the reel 5 and a second (inner) end of the spring 9 is attached to an axle 10, which is rotatable in relation to the reel. Therefore, in order to obtain a design where the spring tension increases when the reel 5 is rotated within the frame 2 in a first direction around the rotation axis 11 while the hose 12 is pulled out from the reel, the axle 10 needs to be kept non-rotatable in relation to the reel 5 during the pulling out of the hose. In the illustrated example this has been accomplished by connecting an outer end 14 of the axle 10 to the lid 6 with engagement means 15 in such a way that mutual rotation between the lid 6 and the outer end 14 is prevented in a direction which decreases the spring force of the spring 9. In the embodiment of FIGS. 1 to 6 these engagement means 15 may be screws attaching the outer end 14 to the lid 15, for instance.

In the illustrated example the outer end 14 of the axle 10 is implemented as a separate part which is detachable from an inner end 16 of the axle. In that case the inner end 16 and the outer end 14 of the axle are implemented in such a way that they are non-rotatably engaged to each other, in other words, once attached to each other, they can be rotated only together. In this example, the outer end 14 of the axle 10 is an elongated part passing from an outside of the lid 6 trough a hole 20 in the lid 6 to engage with the inner end 16 of the axle such that a flange 22 on the outer end 14 contacts an outer surface 21 of the lid 6. The screws working as the engagement means 15 attach the flange 22 to the outer surface 21 the lid 6.

The outer end 14 and the inner end 16 of the axle 10 may be shaped to engage each other in such a way that they are kept together also in the axial direction, in which case the lid 6 may be attached to the frame of the hose reel 1 via the axle 10 only. Alternatively or in addition, it is possible that the lid 6 and frame 2 are attached to each other by other attachment means, such as screws. In any case, due to the fact that the outer end 14 of the axle 10 is kept non-rotatable only by means of engagement to the lid 6, the axle 10 will rotate and the tension of the spring 9 will be lost immediately if the lid 6 is removed. This ensures that at the same time as a user obtains access to the inside of the hose reel by removing the lid, the spring force is lost, and the user can no longer be injured by forces originating from the spring.

Preferably the hose reel 1 is provided with a lock mechanism preventing the rewind mechanism from rewinding the hose while the user utilizes the hose. Once the user has finished using the hose, the user may pull the hose once to release the break such that the rewind mechanism may start rewinding the hose to the reel. Additionally, in order to prevent the rewinding from occurring with a speed that is too high, a break is preferably provided in order to limit the rewinding speed. Such a lock and break may be implemented as in prior art solutions and are therefore not illustrated in detail.

From FIGS. 5 and 6 it can ne seen that the outer end 14 of the axle 10 is provided with corners 23 (such as a nut) for engaging a tool rotating the axle 10. In this way a spanner, for instance, may be utilized for controlled decreasing of the spring tension, or alternatively, increasing of the spring tension, by rotating the outer end 14 of the axle while the screws are removed.

FIGS. 7*a* to 7*f* illustrate a pre-tension hose 24 and a stopper 25. The pre-tension hose 24 can be utilized for releasing the pre-tension of the spring of the hose reel 1 before removing the lid 6. In particular, a solution for safely replacing the hose of the hose reel 1 will be explained by referring to FIGS. 7*a* to 7*f*.

Figure 7A:
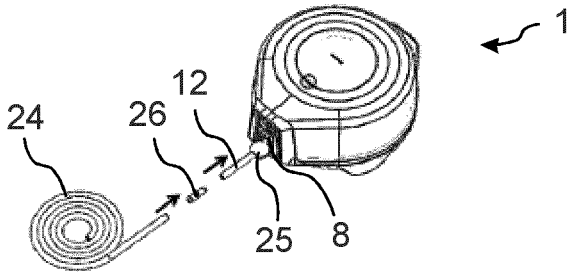
FIGS. 7*a* to 7*f* illustrate a pre-tension hose and a stopper.

In FIG. 7*a* the stopper 25 is illustrated when attached to the outer end of the hose 12, where it by contact with the guide 8 prevents the outer end of the hose 12 from being re-winded all the way into the hose reel 1. An engagement part 26 it utilized for attaching the pre-tension hose 24 to the hose 12.

Figure 7B:
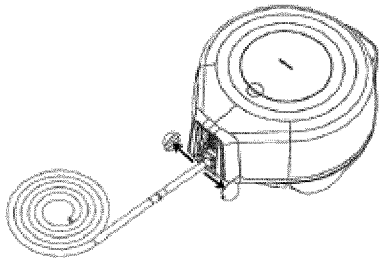
Figure 7C:
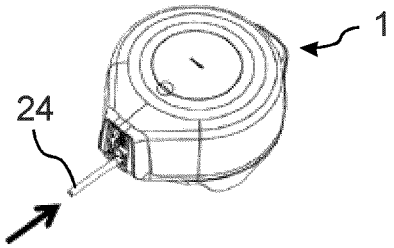
Figure 7D:
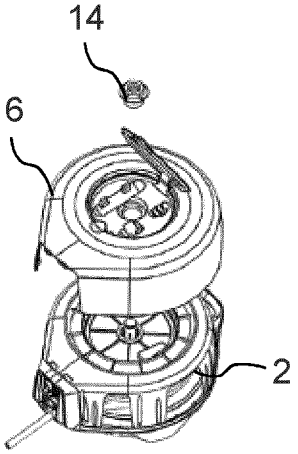
Figure 7E:
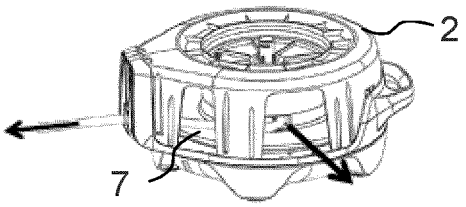
Figure 7F:
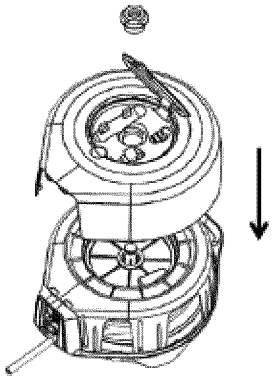

In FIG. 7*b* the stopper 25 is detached which makes it possible in FIG. 7*c* to re-wind the hose 12 and a part of the pre-tension hose 24 into the hose reel 1 until the tension in the spring is completely released. At that stage the outer end 14 of the axle can be detached from the lid 6 and the lid 6 can be safely removed from the frame 2. At this stage the reel 5 can be freely rotated via the side openings 7 of the frame 2 by hand, as illustrated in FIG. 7*e*, which makes it possible to change the hose, for instance.

Finally, once new hose has been fitted, the new hose can be re-winded onto the reel by manually rotating the reel, after which the lid 6 and outer end 14 of the axle can be refitted, and the spring pre-tensioned by pulling out the pretension hose 24 until the stopper 25 can be refitted. After removal of the engagement part 26 and the pre-tension hose 24, the hose reel 1 is again ready for use.

Figure 8:
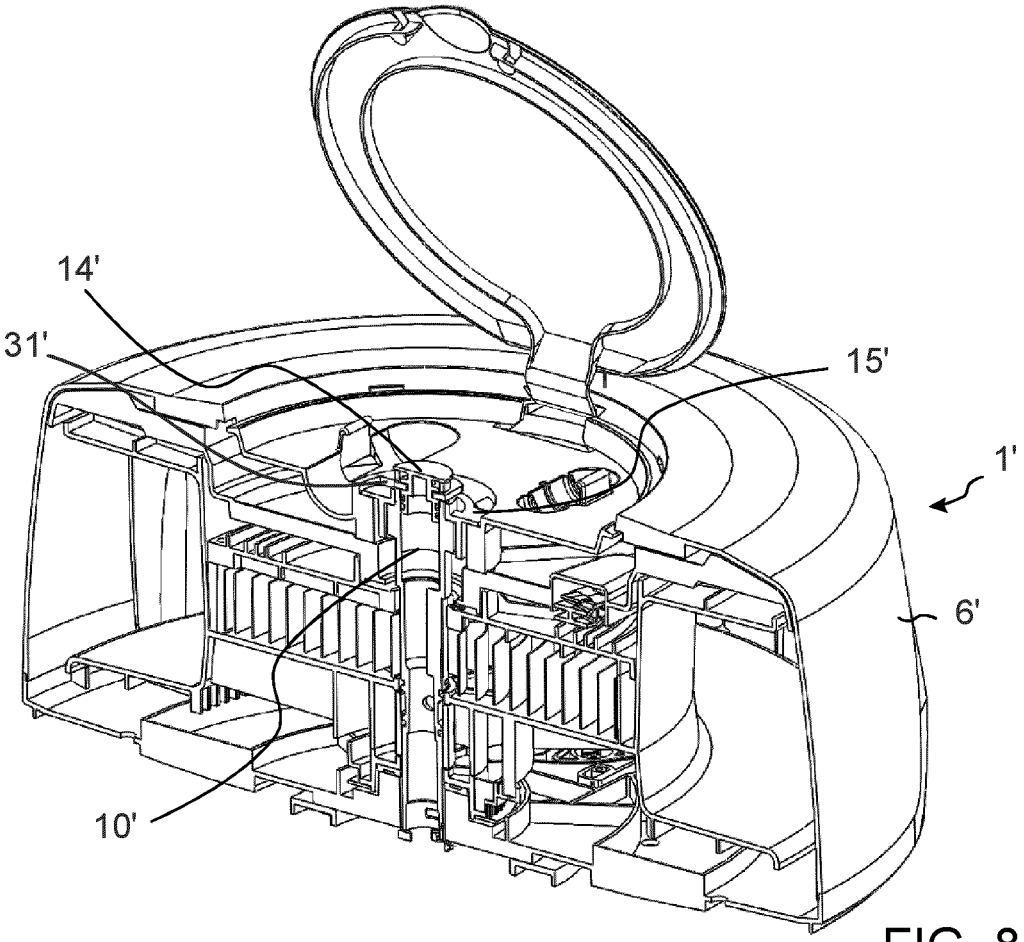
FIGS. 8 to 10 illustrate a second embodiment of a hose reel.
Figure 9:
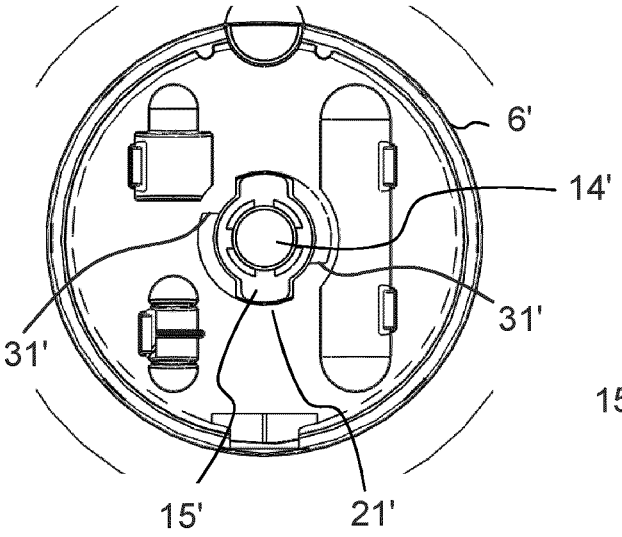
Figure 10:
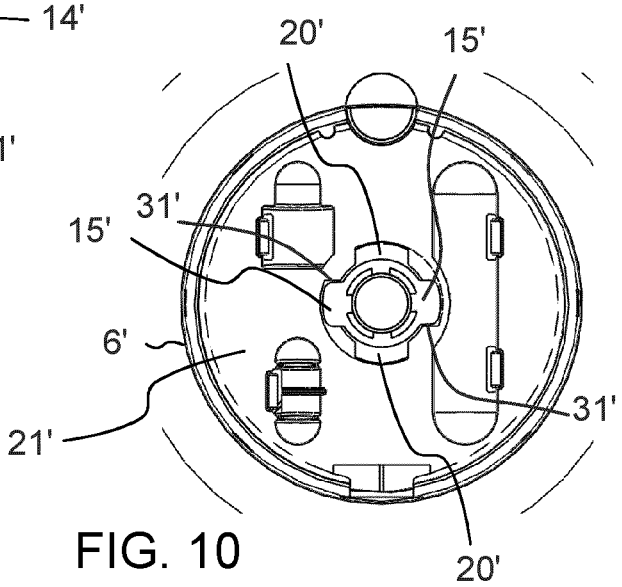

FIGS. 8 to 10 illustrate a second embodiment of a hose reel 1'. The hose reel of FIGS. 8 to 10 is very similar to the one explained in connection with FIGS. 1 to 6. Therefore the embodiment of FIGS. 8 to 10 will in the following be explained mainly by pointing out the differences between these embodiments.

In the second embodiment the axle 10' may be implemented to consist of one single part only. In this embodiment, the outer end 14' of the axle 10' is provided with at least one engagement means 15' extending radially sideways from the outer end of the axle along an outer surface 21' of the lid 6'. The lid 6' is provided with a hole 20' having a shape corresponding to the shape of the outer end 14' of the axle 10' and the engagement means 15'.

In the illustrated example the outer end 14' of the axle is provided with engagement means 15' as two protrusions extending radially sideways in opposite directions. Correspondingly, in the illustrated example, the hole 20' in the lid 6' is provided to have a shape corresponding to the shape of the outer end 14'. Due to this, in a first release position which is illustrated in FIG. 9, the engagement means 15' are aligned with the hole 20', such that it is possible to lift up the lid 6' as the outer end 14' of the axle can pass through the hole 20' in the lid. In a second locked position illustrated in FIG. 10, however, the engagement means 15' extend to the left and right in FIG. 10 and consequently are turned 90° in relation to the hole 20'. Therefore these engagement means 15' contact the outer surface 21' of the lid 6' and prevent removal of the lid 6'.

The lid 6' is additionally provided with at least one shoulder 31' against which the engagement means 15' are pressed by the spring force when the spring 9 of the hose reel 1' is tensioned. Consequently, as long as the spring 9' is tensioned, the engagement means 15' are kept by the spring against the shoulder 31' such that the engagement means 15' prevent the lid 6' from being removed. Once the spring force is released, the user can rotate the outer end 14' of the axle into the release position illustrated in FIG. 9, such that the lid 6' can be removed from the hose reel. This efficiently eliminates the risk of injury, as removal of the lid is prevented as long as the spring has dangerously much tension.

It is to be understood that the above description and the accompanying figures are only intended to illustrate the present invention. It will be obvious to a person skilled in the art that the invention can be varied and modified without departing from the scope of the invention.

The invention claimed is:

1. A hose reel, comprising:

a frame, a reel rotatably arranged within the frame, and a rewind mechanism with a spring with a spring tension that increases when the reel is rotated within the frame in a first direction around a rotation axis while a hose is pulled out from the reel, and which spring tension decreases when the spring rotates the reel in a second direction within the frame to rewind the hose to the reel, wherein the hose reel comprises a removable lid which is attached to the frame and which together with the frame encloses an inside of the hose reel substantially from all directions to prevent a user of the hose reel from accessing the inside of the hose reel, and an axle which is rotatable in relation to the reel, and wherein a first end of the spring is attached to the reel and a second end of the spring is attached to the axle, and the axle has an outer end with engagement screws connecting the outer end of the axle to the lid to prevent mutual rotation between the lid and the outer end in a direction which decreases the spring force of the spring.

2. The hose reel according to claim 1, wherein the axle includes at least the outer end and an inner end which are non-rotatably engaged to each other, and the outer end is an elongated part passing from an outside of the lid through a hole in the lid to engage with the inner end of the axle, such that a flange on the outer end contacts an outer surface of the lid, and the screws attach the flange to the lid.

3. The hose reel according to claim 1, wherein the outer end of the axle is provided with corners for engaging a tool rotating the axle and providing pre-tension to the spring.

4. The hose reel according to claim 1, wherein the hose reel is provided with a guide providing an outlet opening for the hose from the reel, an outer end of the hose is provided with a stopper preventing the outer end of the hose from being re-winded through the opening provided by the guide into the hose reel, and the spring is provided with a pre-tension rewinding the hose to the reel until the stopper contacts the guide and prevents further rewinding of the hose.

5. The hose reel according to claim 4, wherein the hose reel is provided with a pre-tension hose and with an engagement part for attaching the pre-tension hose as an extension to the outer end of the hose, and the stopper is detachably attached to the hose for being removed to allow the outer end of the hose and the pre-tension hose attached to the hose to be re-winded to the reel for releasing the pre-tension of the spring.

6. The hose reel according to claim 1, wherein the frame is provided with side openings providing access to the reel which is arranged in the frame, and the lid is shaped to cover the side openings while being attached to the frame.

7. A hose reel, comprising:

a frame, a reel rotatably arranged within the frame, and a rewind mechanism with a spring with a spring tension that increases when the reel is rotated within the frame in a first direction around a rotation axis while a hose is pulled out from the reel, and which spring tension decreases when the spring rotates the reel in a second direction within the frame to rewind the hose to the reel, wherein the hose reel comprises a removable lid which is attached to the frame and which together with the frame encloses an inside of the hose reel substantially from all directions to prevent a user of the hose reel from accessing the inside of the hose reel, and an axle which is rotatable in relation to the reel, and wherein a first end of the spring is attached to the reel and a second end of the spring is attached to the axle, the axle has an outer end with at least one protrusion extending radially sideways from the outer end of the axle along an outer surface of the lid, the lid is provided with a hole having a shape corresponding to the shape of the outer end and the at least one protrusion, such that the outer end and the at least one protrusion may pass through the hole while the axle is rotated into a release position, and which prevents the outer end and the at least one protrusion from passing through the hole when the axle is not in the release position, and the lid is provided with a shoulder against which the at least one protrusion is pressed by the spring force when the spring of the hose reel is tensioned such that the outer end of the axle is connected to the lid to prevent mutual rotation between the lid and the outer end in a direction which decreases the spring force of the spring.

8. The hose reel according to claim 7, wherein the hose reel is provided with a guide providing an outlet opening for the hose from the reel, an outer end of the hose is provided with a stopper preventing the outer end of the hose from being re-winded through the opening provided by the guide into the hose reel, and the spring is provided with a pre-tension rewinding the hose to the reel until the stopper contacts the guide and prevents further rewinding of the hose.

9. The hose reel according to claim 8, wherein the hose reel is provided with a pre-tension hose and with an engagement part for attaching the pre-tension hose as an extension to the outer end of the hose, and the stopper is detachably attached to the hose for being removed to allow the outer end of the hose and the pre-tension hose attached to the hose to be re-winded to the reel for releasing the pre-tension of the spring.

10. The hose reel according to claim 7, wherein the frame is provided with side openings providing access to the reel which is arranged in the frame, and the lid is shaped to cover the side openings while being attached to the frame.

* * * * *